United States Patent [19]

Opresik et al.

[11] 4,262,911

[45] Apr. 21, 1981

[54] MARTIAN FLYER OR EARTH U.F.O.

[76] Inventors: John Opresik, c/o George Spector, 3615 Woolworth Bldg., 233 Broadway; George Spector, 3615 Woolworth Bldg., 233 Broadway, both of New York, N.Y. 10007

[21] Appl. No.: 952,483

[22] Filed: Oct. 18, 1978

[51] Int. Cl.[3] ..... A63B 65/00

[52] U.S. Cl. ..... 273/428; 273/425; 273/58 K

[58] Field of Search ..... 273/106 R, 106 B, 58 K, 273/105.4, 105.5, 362–365, 424, 425, 428; 46/74 D, 74 R, 75; D21/77, 85, 86, 87, 91

[56] References Cited

U.S. PATENT DOCUMENTS

| | | | |
|---|---|---|---|
| D. 173,270 | 10/1954 | Lindberg | D21/86 |
| D. 200,913 | 4/1965 | Wolfe | D21/87 X |
| D. 211,377 | 6/1968 | Lakin | D21/85 |
| 248,362 | 10/1881 | Spangler | 273/105.5 X |
| 290,788 | 12/1883 | Moyer | 273/105.5 |
| 2,490,031 | 12/1949 | Core | 273/106 F |
| 2,835,073 | 5/1958 | Dame | 273/106 F X |
| 3,220,142 | 11/1965 | Butterfield | 273/106 F X |
| 3,673,731 | 7/1972 | Farhi et al. | 46/74 D X |

*Primary Examiner*—Paul E. Shapiro

[57] ABSTRACT

A flying game device that spins as it travels through the air, the device including a generally spherical, hollow body surrounded by a circular wing which in one design of the invention is detachable from the body so that the wing forms a spinning disc, and the body in another design being spiral finned and spring attached to the wing.

1 Claim, 5 Drawing Figures

MARTIAN FLYER OR EARTH U.F.O.

This invention relates generally to activity toys and sport devices. More specifically it relates to game devices of the type such as the well known Frisbee which is thrown in the air.

A principal object of the present invention is to provide a flying game device which is in a general shape of an U.F.O. (unidentified flying object) as popularly conceived to be, so that it will appeal to the imagination of players as they throw it and observe it flying through the air.

Another object is to provide an earth U.F.O game device that includes an enlarged central body surrounded by a circular wing so that its principal weight is at a center thus giving a good balance, and which is less effected by wind than a Frisbee during flight.

Yet another object is to provide an earth U.F.O. game device that will give diversion to both adults and children out-of-doors such as in a park, back yard, beach or at a swimming pool.

Figure 1:
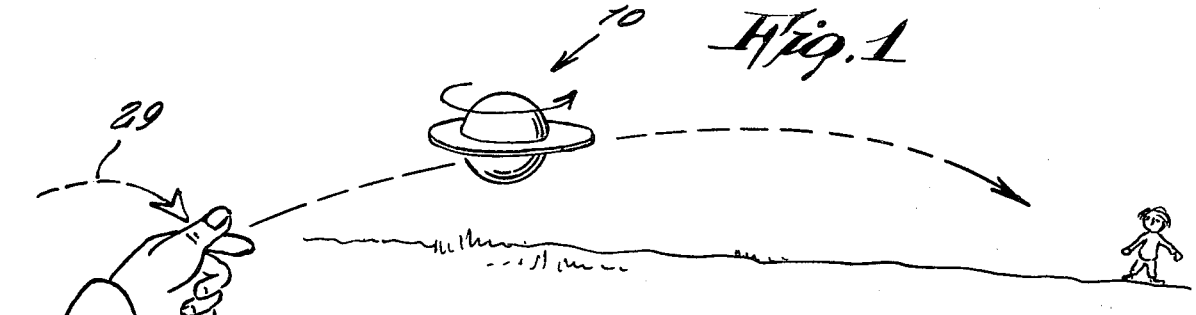
FIG. 1 is a perspective view of the invention shown in use.
Figure 2:
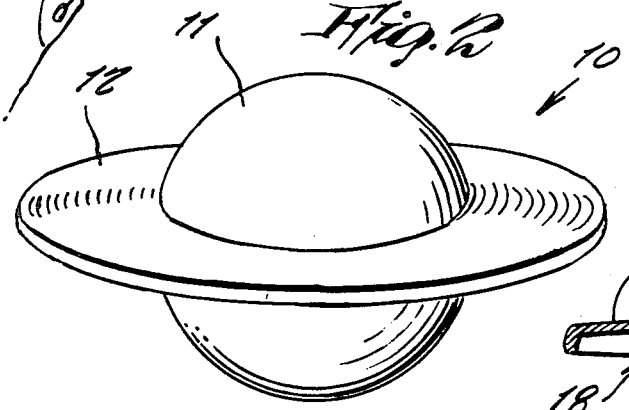
FIG. 2 is an enlarged view thereof.

Referring now to the drawing in greater detail, and more particularly to FIGS. 1 and 2 thereof at this time, the reference numeral 10 respresents a Martial Flyer or Earth U.F.O. game device according to the present invention wherein there is a hollow, spherical body 11 integral with a circular, generally flat wing 12 therearound. The device is molded of thin, relatively rigid plastic so to be light weight in order to stay a long time in the air during a flight.

In use, it is tossed between players, being thrown so that it spins in flight, as shown in FIG. 1.

Figure 3:
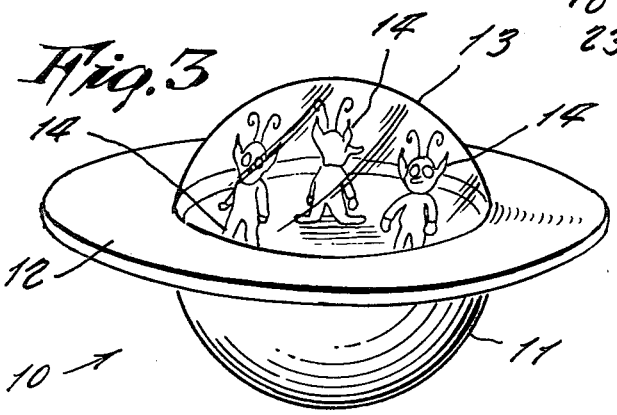
FIG. 3 is a perspective view of a modified design of the invention in which the upper dome is transparent so to view three Martian Figurines contained inside the U.F.O.
Figure 4:
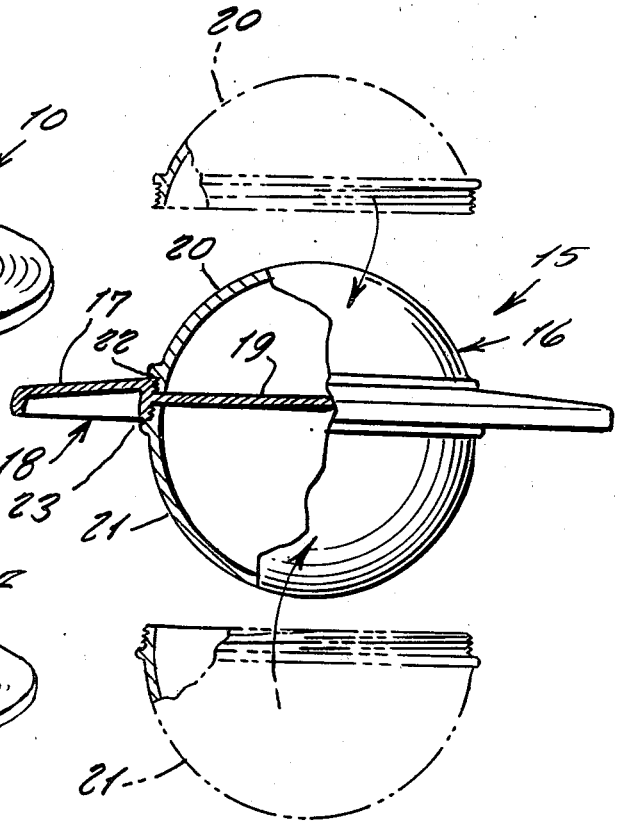
FIG. 4 is a cross sectional view of another modified design of the invention in which the craft is made of three plastic components that screw thread together so that they could be disassembled in order to allow use of the flat disc alone, if so preferred.

FIG. 3 illustrates a modified construction thereof wherein the upper portion of the spherical body is made of transparent plastic so to form a dome 13 that allows observation of figurines 14 inside, representing Marsians. In FIG. 4, a flying device 15 includes spherical body 16 surrounded by circular wing 17 that can be dismantled from each other so to form a flying disc 18. In this design, the wing is made integral with a central, circular flat panel 19, so that with the wing it forms the disc 18. The body is comprised of upper and lower sections 20 and 21 that are removably screwed to internal screw threads formed on upper and lower portions of the disc, as shown at 22 and 23. It is to be noted from FIG. 4 that in all designs of this invention, the upper section is smaller than the lower section in order to give a good flying balance.

Figure 5:
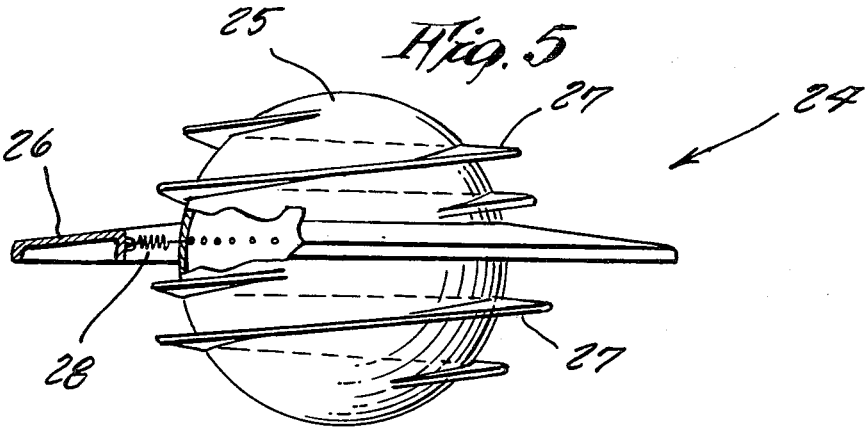
FIG. 5 is a side view of still another modified design in which the spherical body includes a spiral airfoil so to give lift to the craft as it rotates which travelling, in order to travel higher and further, the circular wing being spring attached to the sphere body so to give an initial thrust to the craft when launched.

In FIG. 5, another design of flying game device 24 includes spherical body 25 and circular wing 26, the body having an outward spiral fin 27 on its upper and lower portions, the fins extending horizontally and being spiralled in a same rotational direction so that when the device is in flight, the fins screw their way vertically upwardly in order to give additional lift to the craft, so that it can stay longer in the air before discending, thus giving it a longer flying range.

Additionally the wing 26 is attached to the body 25 by radially extending tension coil springs 28 therebetween, so that when launched, the arcuate movement of a hand (as shown by arrow 29 in FIG. 1) causes the springs to stretch and thus impart a kicking thrust in a forwardly spinning direction when the springs thereafter contract to normally relaxed length, it being noted that in launching the craft, it is held by its wing being held between a persons fingers, as also clearly indicated in FIG. 1.

What is claimed is:

1. A flying toy, comprising in combination, a hollow spherical body and a wing surrounding said body, said wing and body being connected by means for providing additional thrust when the toy is propelled by flinging the toy while holding said wing, said body has upper and lower portions having spiral fins.

* * * * *